US005598675A

United States Patent [19]

Pruss

[11] Patent Number: 5,598,675

[45] Date of Patent: Feb. 4, 1997

[54] CONCRETE WALL MONOLITHIC BUILDING UNIT

[76] Inventor: Donald E. Pruss, P.O. Box 223160, Carmel, Calif. 93922-3160

[21] Appl. No.: 448,400

[22] PCT Filed: Mar. 14, 1995

[86] PCT No.: PCT/US95/02973

§ 371 Date: Jun. 7, 1995

§ 102(e) Date: Jun. 7, 1995

[87] PCT Pub. No.: WO95/25207

PCT Pub. Date: Sep. 21, 1995

[30] Foreign Application Priority Data

Mar. 16, 1994 [CA] Canada ..... 2119180

[51] Int. Cl.[6] ..... E04C 1/00

[52] U.S. Cl. ..... 52/309.4; 52/426; 52/439

[58] Field of Search ..... 52/309.4, 309.7, 52/309.11, 426, 427, 428, 438, 439, 434, 309.12, 698, 712; 249/40, 189, 190, 213, 111

[56] References Cited

U.S. PATENT DOCUMENTS 4,229,920 10/1980 Lount .
4,288,962 9/1981 Kavanaugh .
4,706,429 11/1987 Young .
4,862,660 9/1989 Raymond .

*Primary Examiner*—Creighton Smith

[57] ABSTRACT

There is disclosed a monolithic unit having spaced apart panels for concrete walls in which the unit includes in one embodiment tie members having a chemically similar polymeric composition to that of the panels but differing in a physical form. The result is a fusibly connected integral unit.

19 Claims, 4 Drawing Sheets

CONCRETE WALL MONOLITHIC BUILDING UNIT

FIELD OF THE INVENTION

The present invention relates to a building unit and more particularly, to a monolithic foam panel unit employed in concrete wall construction.

BACKGROUND OF THE INVENTION

There has been numerous related building units proposed in the art herein previously. Typically of the prior art arrange-ments is exemplified by U.S. Pat. No. 4,731,968. This reference discloses a building unit including the use of an apertured tie members for interconnecting the panels. The patentee extols the advantages of providing aperture in the tie which occupy pressure and tension zones within the foam panels when concrete is charged therebetween. The patentee does not teach a system of employing similar polymers for both the tie members and panels resulting in a superior unit.

Delozier, in U.S. Pat. No. 4,223,501, discloses a concrete form in which the panels are connected by both expanded metal ties and second apertured ties embedded into the panels. This patent does not disclose a fusibly interconnected system to which finishing material may be easily affixed, such as that of the present invention.

Young, in U.S. Pat. No. 4,706,429, teaches the use of a synthetic tie for interconnecting the panels. This system relies on slotted panels into which flanged sections of the ties interfit. The patent does not contemplate the advantages associated with fusible connection between tie and panel and further only provides a minor area on the flange portions, thus preventing rapid and simple fastening of finishing material to the assembled unit.

Further related prior art includes the following U.S. Pat. Nos. 4,228,962, 4,604,843, 4,706,429, 4,862,660, 4,889,310 and 5,065,561.

SUMMARY OF THE INVENTION

Although the prior art has provided a diverse range of structures for the ties and panels, there has been no provision for a fusibly interconnected unit. The present invention satiates the need for such an arrangement, and in one aspect of the invention there is provided an insulated wall construction form comprising: a pair of spaced apart panels, each having an inside surface and an outside surface adapted to receive concrete therebetween, the panels comprising a first polymer; and tie members extending between and interconnecting the panels, the tie members comprising a second polymer compatible with the first polymer for fused engagement with the panels.

The panels for use in the present invention, according to one embodiment, comprise expanded polystyrene (EPS) and serve as a permanent form for concrete construction. Such panels are particularly advantageous for using in building structures since speed of assembly is attractive as well as the exceptional thermal insulation properties. Generally speaking, EPS depending on the thickness and density thereof can provide an R value of 200 or greater in excess of code requirements. In addition, expanded polystyrene does not deteriorate in service, is non-nutritive to pests, rodents and insects and is one of the least energy consuming types of insulation to produce.

Generally speaking, other polymers will provide utility where the panel and tie are compatible such that fusion therebetween is possible. As a further example, one may employ expandable polypropylene for the panel composition and propylene or polyethylene for the tie. Other suitable combinations will be readily appreciated by those skilled.

In terms of the tie members, the use of a synthetic polymeric material completely circumvents problems and limitations previously encountered when metal ties were employed.

The use of metal ties establishes a thermal bridge thus having negative energy consequences. Further, metal ties, such as those in the prior art are only surrounded by the material of the panel, rather than being fused to form a consolidated monolithic unit. The "surrounding" type of wall is plagued with problems. One of the primary problems is that once positioned within the panel, subsequent application of auxiliary coverings, e.g. wallboard is difficult and often results in fasteners used for the coverings becoming deflected or broken by the flange of the ties or missed entirely due to the size and shape of the flange.

Accordingly, the use of a panel and tie system in which the elements comprise polymers compatible for fused connection obviates the inadequacies of the systems presently known. As such, a further aspect of the present invention is to provide a mold for forming concrete walls, the mold having a pair of spaced apart foam panels comprising a polymer of a first type, the panels interconnected by tie means, the improvement wherein: the tie means comprises a material having a melting temperature less than a heat of formation temperature of-the-foam panels whereby when the panels are formed in contact with the tie means, the tie means fusibly engage the panels.

Suitable adhesives may be optionally used in conjunction with the fusion system to further enhance the bond.

According to a further aspect of the present invention there is provided a monolithic building unit comprising: a first panel and a second panel in spaced relation, each panel comprising an expanded foam polymer of a first type; and at least one tie member comprising a second polymer different from the .first polymer, said tie means extending and fusibly connected to each panel, whereby the monolithic unit is an integral form.

As a further advantage of the present invention, when the tie comprises a plastic material, the same may be easily cut to accommodate electrical conduits, plumbing conduits, etc. without any significant compromise of strength in the monolithic units. This is in marked contrast to metal tie arrangements which, not only present difficulty in cutting, but also result in jostling of the metal tie which partially disconnects the contact of the metal to the foam. Clearly this is disadvantageous.

BRIEF DESCRIPTION OF THE DRAWINGS

Having thus generally described the invention, reference will now be made to the accompanying drawings, illustrating preferred embodiments, and in which:

Referring to FIG. 1, numeral 10 generally designates a modular plastic concrete form structure according to the present invention.

The structure 10 is composed of a pair of spaced apart polymeric panels defining a space therebetween into which may be charged concrete. The panels may comprise any suitable material, however, in a preferred form, the panels comprise expanded polystyrene (EPS).

Each of the panels 12 and 14 include an inside and outside surface, and a top and bottom 16, 18, 20, 22 and 24, 26, 28 and 30, respectively. The panels 12 and 14 may include any form of cooperating engagement members for stacking of similar units, illustrated in the example as a tongue and groove arrangement 32, 34 associated with a respective top and bottom of each panel. Lateral engagement between units may be achieved by suitable cooperating engagement members.

Figure 1:
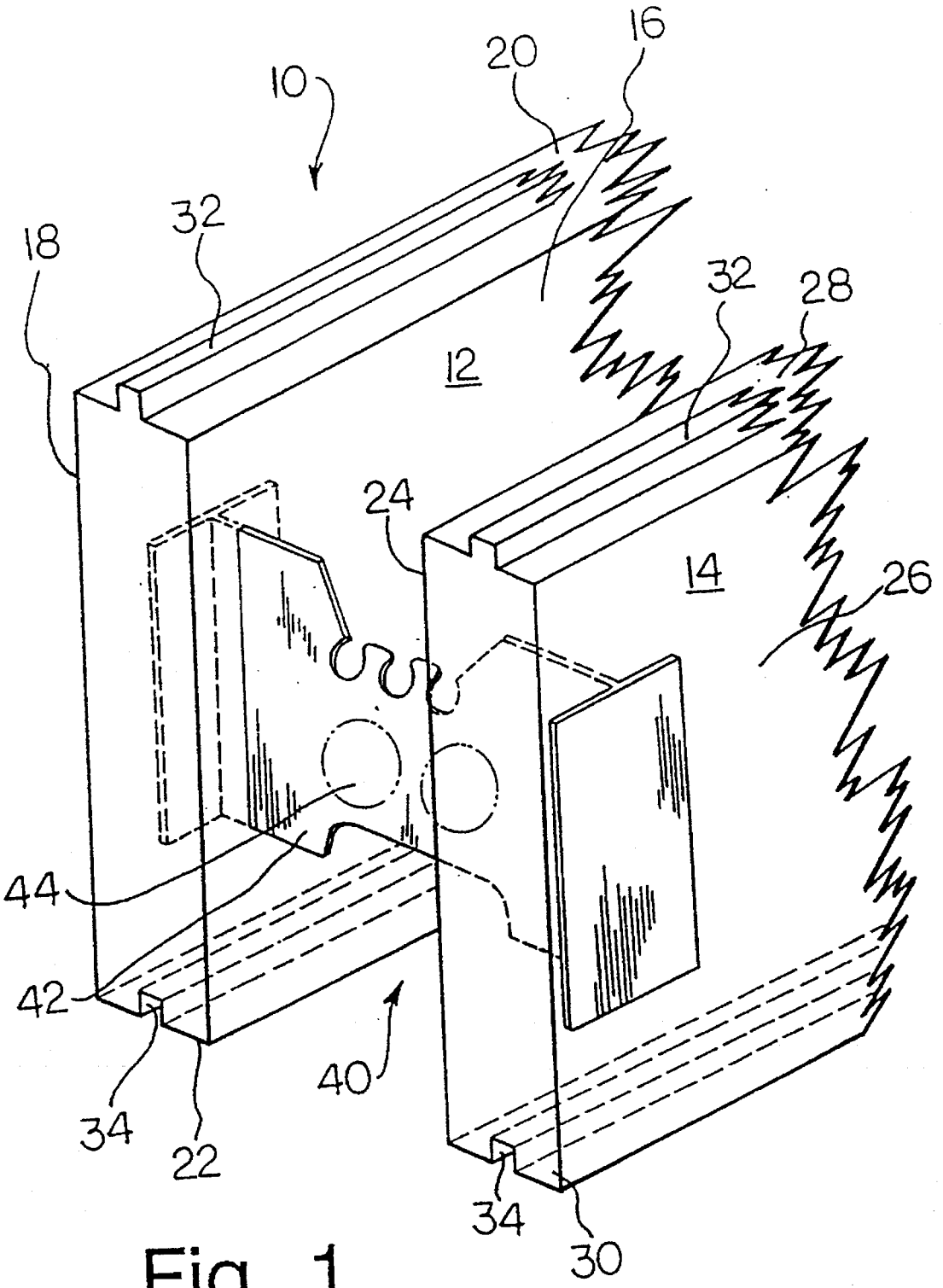
FIG. 1 is a perspective view of the form according to the present invention.

As is broadly shown in FIG. 1, the tie members 40 extend between the panels 12 and 14 and include a broad portion 42 into which may optionally be located a plurality of openings 44, shown in dotted outline.

The tie members 40 provide first and second opposed surfaces 46, 48 of main body 42 with opposed ends 50, 52 including flange members 54 and 56 extending generally orthogonally from body 42 relative to the length thereof.

Preferably, flange members 54 and 56 comprise fairly broad flanges relative to the length of the body 42; such an arrangement has structural ramifications when associated with the panels 12 and 14.

Figure 2:
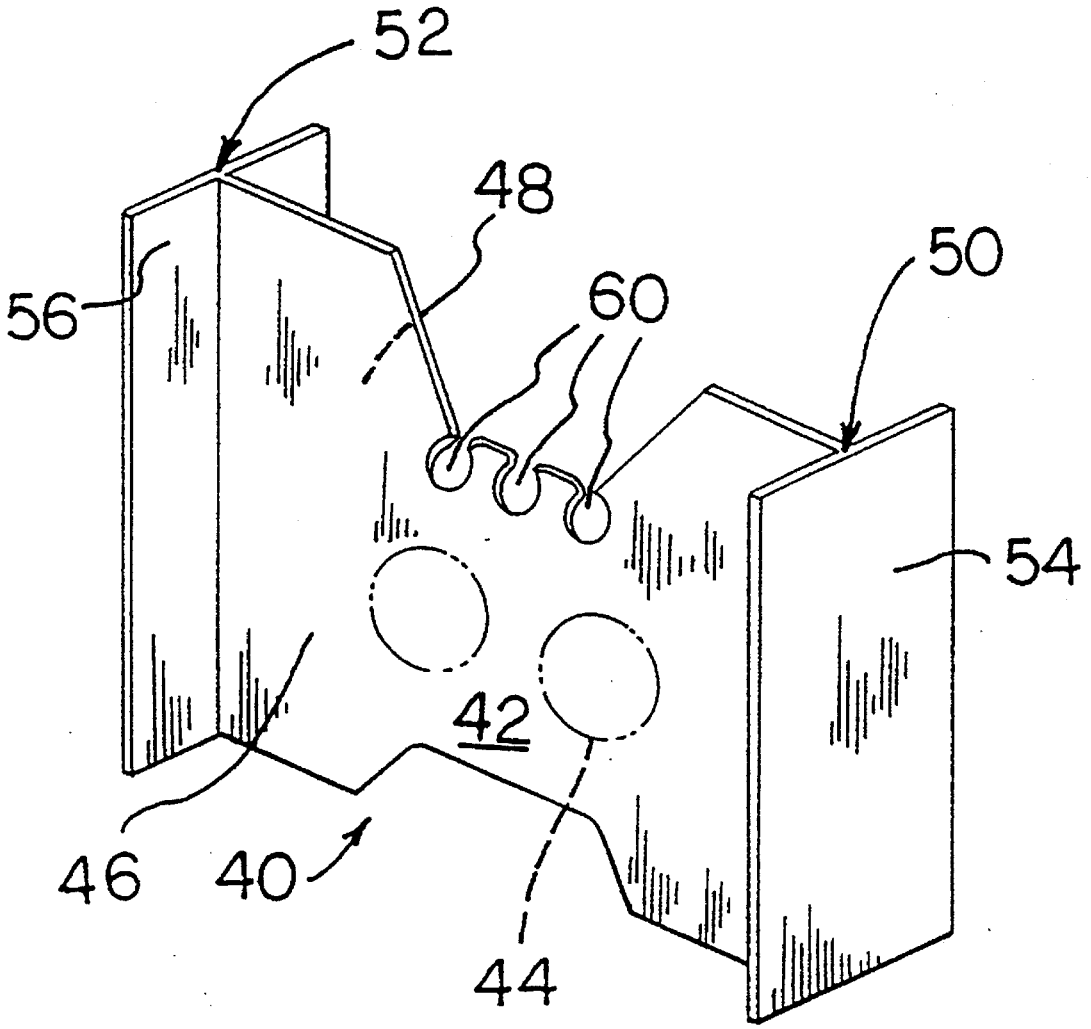
FIG. 2 is a perspective view of one embodiment of the tie members employed in the formwork.

In greater detail the tie members 40 as illustrated in FIG. 2, comprise a polymer which is "chemically compatible" i.e., a congener or copolymer of the EPS e.g. polypropylene-polyethylene, non-expanded polystyrene, etc. In a preferred form, the tie members comprise HIPS (high impact polystyrene) in an extruded form. Use of such compatible materials results in a fused bond between the panels 12 and 14, flange members 54 and 56 as well as respective segments of body 42.

Integrally formed reinforcement bar (not shown) or "rebar" openings 60 are provided within the main body 42 to frictionally retain the bars. Numerous-rebar diameters may be accommodated in such openings.

The use of similar chemical materials, as will be appreciated by those skilled in the art, produces an extremely strong unit since the tie members and panels are effectively consolidated into a unit and accordingly, the degree of contact between flange and panel is maximized and integral.

One of the particularly attractive features of employing the system described is that the tie members 40 are not unduly restricted as to positioning between the panels; this is in contrast to conventional metal ties which must be sufficiently embedded within the panels in order to function.

Figure 3:
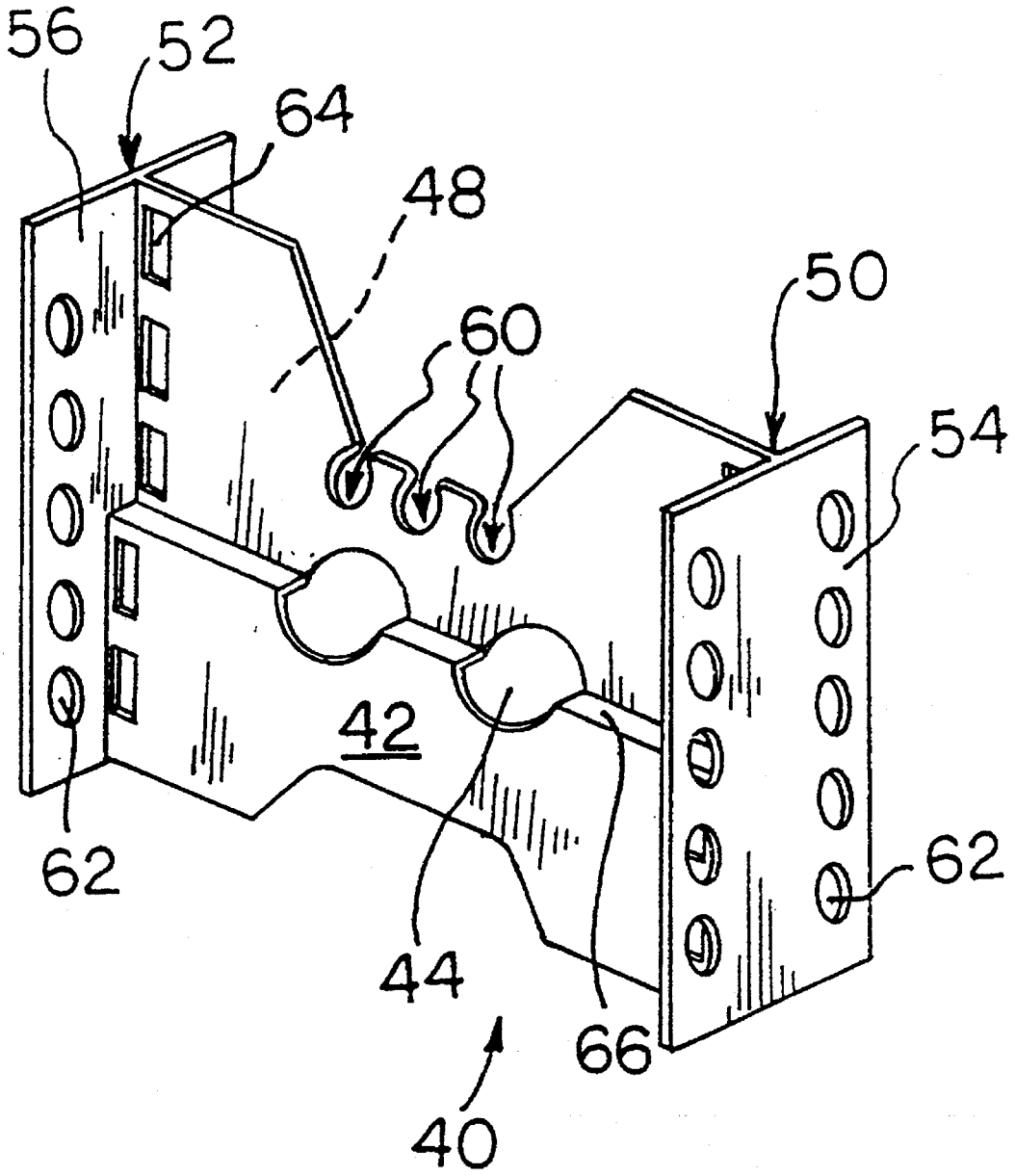
FIG. 3 is a perspective view of another embodiment of the tie members.

FIG. 3 illustrates a further embodiment of the tie members. Similar numerals are employed to denote common elements from the initially presented embodiment.

In the embodiment illustrated in FIG. 3, the tie members includes a plurality of apertures 62 extending through each flange 54 and 56 with the apertures 62 being on both sides of each flange, relative to the main body 42. Proximate each end 50 and 52 of the tie members 40, there is further included apertures 64 extending through body 42. The inclusion of apertures 44, 62 and 64 has particular benefit in terms of the degree of contact between the foam material (not shown) and the tie members 40. Clearly, since a greater number of apertures are available, more foam material can flow through and around the tie members during the formation of the mold, the latter being illustrated in one form in FIG. 1.

The positioning of the apertures 44, 62 and 64 has been found to be particularly effective in unit integrity. The positioning of apertures 62 facilitates increased bonding contact between the flanges 54 and 56 and the width or transverse direction of a respective panel. Similarly, apertures 64 are particularly useful for enhanced longitudinal contact within a respective panel.

The combination of similar polymer for fused connection for the panels and tie members, together with a higher degree of contact between the tie and panels, imparts exceptional strength to the unit. This strength is further compounded by the presence of apertures 44 within body 42 to permit the flow through of concrete or other charge material, charged between the panels.

As an example, the polystyrene that can be employed in the present invention may be a polystyrene resin, Styron™, manufactured by Dow Plastics of Midland, Mich. having the following properties:

| | | | |
|---|---|---|---|
| Melt Flow Rate, g/10 min. 5 kg. 200° C. | D1238 | 5.0 | 5.0 |
| Vicat Softening Point, °F., °C., Rate B | D1525 | 226 | 106 |
| Yield Tensile Strength, psi, kgf/cm$^2$ | D638 | 6440 | 450 |
| Ultimate Tensile Strength, psi, kgf/cm$^2$ | D638 | 6440 | 450 |
| Ultimate Tensile Elongation, % | D638 | 1.6 | 1.6 |
| Tensile Modulus, psi, kgf/cm$^2$ | D638 | 420,000 | 29,500 |
| Hardness, Rockwell M | D785 | 74 | 74 |
| Deflection Temperature Annealed °F., at 264 psi. °C. at 16.6 kgf/cm$^2$ | D648 | 195 | 91 |
| Specific Gravity (density) | D972 | 1.04 | 1.04 |

The Styron is manufactured in numerous physical forms including extruded forms, beads for expansion, etc.

In the case where HIPS is used for the tie, this material may have a melting point of approximately 82° C. (180° F.) with the heat of formation of the foam panels of approximately 116° C. (240° F.).

A step or ledge 66 is provided on the embodiment illustrated in FIG. 3 and extends the length of main body 42. The ledge has the advantage of urging an upper unit, when the units are superposed, into engagement with a lower unit. This can be realized when the stacked units are charged with cement. As the cement flows in between the panels, each ledge 66 is effectively an impedance to the flow. Accordingly, a downward pressure is exerted which, in turn, forces engagement between the tongues of a lower unit and the grooves of an upper unit.

Figure 4:
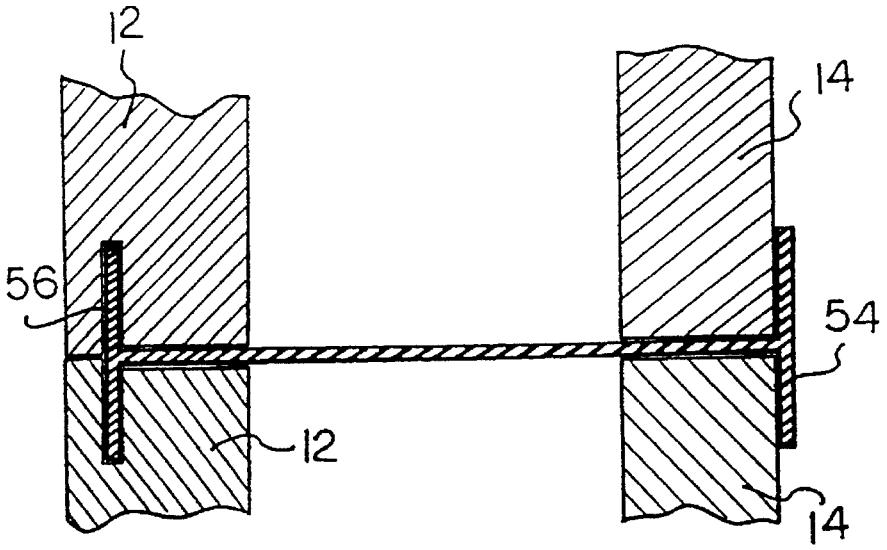
FIG. 4 is a top plan view of one possible arrangement for the disposition of the tie members between the panels.

FIG. 4 illustrates as an example, one positioning arrangement in which two panels 14 may be juxtaposed with the ends thereof terminating at the juncture of the flange 52 to main body 42 of tie members 40, while the opposed end remains embedded between two juxtaposed panels 12. In this arrangement, flange 52 extends outwardly of the outside face of each panel 14.

Figure 5:
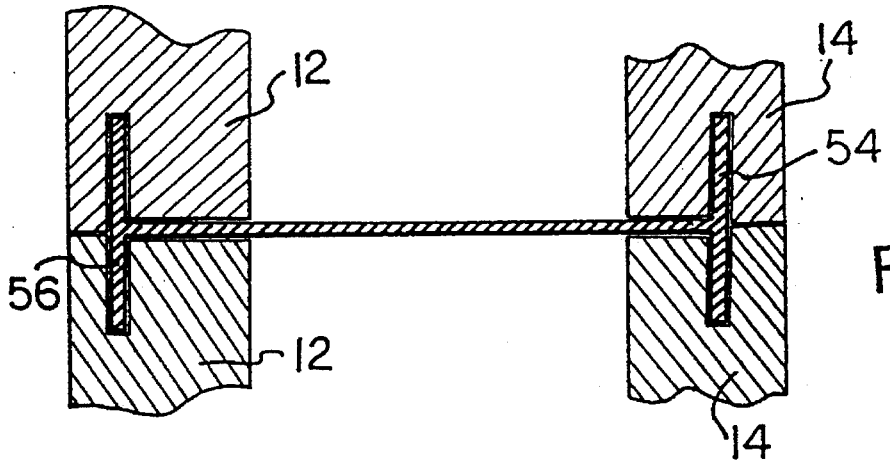
FIG. 5 is a second perspective view of another embodiment of the tie members.

FIG. 5 illustrates a further possible arrangement wherein both the flanges 54 and 56 are embedded within the juxtaposed panels 12 and 14.

Figure 6:
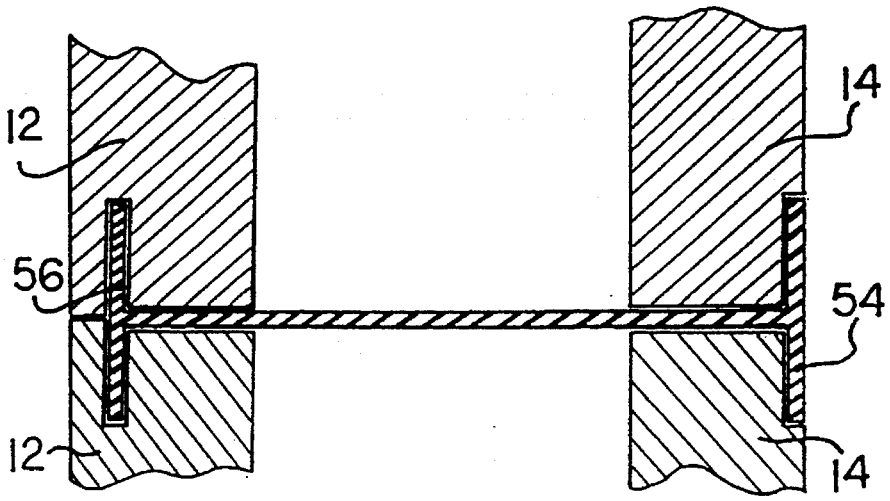
FIG. 6 is a third perspective view of another embodiment of the tie members.

FIG. 6 illustrates yet another embodiment of the arrangement, in which flange 54 is flush relative to the outside surfaces of each panel 14.

Any combination of the aforementioned arrangements may be employed in a molding unit and further, such arrangements may easily be employed in a single length of panel 12 and 14 rather than at the point of juxtaposition between similar panels as illustrated.

The desired positioning between the tie members and panels will vary depending upon the desired application.

In addition to the positioning flexibility, the use of the tie members 40 in the manner illustrated in FIGS. 1 and 3 through 6, clearly provides a readily accessible and broad surface for the attachment of secondary finishing material thereto, e.g. wallboard. Since the tie members 40 comprises a rigid polymeric material, the same may be easily drilled, screwed or nailed without sacrificing the integrity of the bond, a feature notably absent from the prior art. Further, in view of the fact that non-metal ties are used, the use of metal screws, nails, etc. may be readily used as fasteners with the present invention without the drawback of thermal bridging between tie and fastener as encountered in the prior art.

In terms of fabrication, the tie members 40 may be formed by an extrusion, injection moulding or other plastic forming process well known to those skilled in the art.

In order to fabricate a mold unit such as that, for example, as illustrated in FIG. 1, the tie members 40 are positioned according to the desired location and the foam material foamed therearound by well known foam panel manufacturing techniques.

In a further attendant feature of the present invention, the flange 54 and 56 will preferably have a breadth from about 25 to about 75% the length of body 42. This range generally provides an adequate amount of surface for panel contact as well. as providing a broad surface to receive nails, screws, etc. for mounting additional material, e.g. wallboard.

In exothermic foaming of the panel, the polymers for the panels and tie members to the foam will be selected such that the bonding temperature of the tie members is below the temperature of the heat of formation of the foam panels. This selection results in the fused connection of the tie members to the panel material, thus ensuring a strong bond therebetween.

In endothermic foaming procedures, the tie will be positioned within the foam mold such that the foam surrounds at least the flanges of the tie members.

In an alternate embodiment, the tie members for use in the monolithic unit may comprise a metal body, plastic body or any other suitable substrate capable of retaining a polystyrene coating or any other coating compatible with the material of which the foam panel is made. Further still, it is contemplated that the tie include only localized coated areas for fusible connection with the panel. In this respect, only the areas contacting the foam panel would require the coating.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. An insulated wall construction form comprising:

a pair of spaced apart panels, each having an inside surface and an outside surface adapted to receive concrete therebetween, said panels comprising a first polymer; and tie means extending between and fusibly interconnecting said panels, said tie means comprising a second polymer fusible with said first polymer of said panels to provide an integral and chemically bonded insulated wall construction.

2. The construction as set forth in claim 1, wherein said first polymer and said second polymer are similar polymers.

3. The construction as set forth in claim 1, wherein said first polymer is a copolymer of said second polymer.

4. The construction as set forth in claim 1, wherein said tie means comprises an extruded polymer, said tie means including at least one integral opening adapted to receive a reinforcement bar therein.

5. The construction as set forth in claim 4, wherein said tie means includes a central body portion having opposed faces and opposed ends, each end including flange means extending orthogonally relative to said faces.

6. The construction as set forth in claim 5, wherein said flange means of one of said opposed ends is bonded to outside surfaces of said panels.

7. The construction as set forth in claim 6, wherein said flange means bonded to outside surfaces of said panels is adapted to mount finishing material thereon.

8. In a mold for forming concrete walls, said mold having a pair of spaced apart foam panels comprising a polymer of a first type, said panels interconnected by tie means, the improvement wherein:

said tie means comprises a material having a melting temperature less than a heat of formation temperature of said foam panels whereby when said panels are formed in contact with said tie means, said tie means fusibly engage said panels.

9. The mold as set forth in claim 8, wherein said foam panels comprise expandable polystyrene.

10. The mold as set forth in claim 8, wherein tie means comprise a polystyrene.

11. The mold as set forth in claim 8, wherein said polymer comprises a high impact polystyrene.

12. The mold as set forth in claim 8, wherein said tie means comprises a substrate having a coating, said coating comprising a material having a bonding temperature less than a heat of formation temperature of said foam panels.

13. The mold as set forth in claim 12, wherein said coating is a localized coating associated with portions of said tie means contacting said panels.

14. A monolithic building unit comprising:

a first panel and a second panel in spaced relation each panel comprising an expanded foam polymer of a first type; and at least one tie means comprising a second polymer different from said first polymer, said tie means extending and fusibly connected to the panels, whereby said monolithic unit is an integral form.

15. The monolithic building unit as set forth in claim 14, wherein each unit includes cooperating engagement means adapted for cooperative engagement with an adjacent monolithic unit.

16. The monolithic building unit as set forth in claim 14, wherein said expanded foam polymer comprises expanded polystyrene.

17. The monolithic building unit as set forth in claim 14, wherein said tie means comprises high impact polystyrene.

18. The monolithic building unit as set forth in claim 14, wherein said expanded foam polymer comprises polypropylene.

19. The monolithic building unit as set forth in claim 14, wherein said tie means comprises polypropylene.

* * * * *